United States Patent [19]

Duve

[11] Patent Number: 4,649,239

[45] Date of Patent: Mar. 10, 1987

[54] PROGRAM TIMER WITH VARIABLE TIME DELAY

[75] Inventor: John P. Duve, Brookfield, Ill.

[73] Assignee: Eaton Corporation, Cleveland, Ohio

[21] Appl. No.: 784,022

[22] Filed: Oct. 4, 1985

[51] Int. Cl.[4] ..... H01H 43/00

[52] U.S. Cl. ..... 200/38 R; 200/38 B; 368/108

[58] Field of Search ..... 200/33–38, 200/39; 74/122–125; 368/107–109

[56] References Cited

U.S. PATENT DOCUMENTS

| | | | |
|---|---|---|---|
| 3,724,248 | 4/1973 | Obermann | 74/122 |
| 4,442,326 | 4/1984 | Wagle | 200/38 R |
| 4,500,212 | 2/1985 | Wojtanek | 200/38 B |
| 4,536,626 | 8/1985 | Wojtanek | 200/35 R |
| 4,536,627 | 8/1985 | Duve | 200/38 R |
| 4,551,590 | 11/1985 | Mahon | 200/38 R |

*Primary Examiner*—Vit W. Miska

*Attorney, Agent, or Firm*—D. A. Rowe; R. A. Johnston

[57] ABSTRACT

A delay arrangement for a program timer having a rotatable timing cam member (monoblock) including a delay ratchet wheel having a pin which engages an abutment inside the monoblock at one relative position of the delay ratchet to the monoblock. The monoblock ratchet ring has a gap at the desired delay position so that when the delay ratchet wheel is set to a desired delay, and the drive pawl is at the delay position, the drive pawl extends into the gap to only move the delay ratchet wheel until the pin engages the monoblock. The monoblock is then advanced along with the delay ratchet wheel until such time as the gap in the monoblock ratchet ring has advanced past the drive pawl. From then on, the regular monoblock advance takes over.

5 Claims, 6 Drawing Figures

PROGRAM TIMER WITH VARIABLE TIME DELAY

BACKGROUND OF THE INVENTION

This invention relates to program timers and, more particularly, to an arrangement for providing a variable time delay for a program timer.

When using an appliance controlled by a program timer, it is sometimes desirable to be able to select the program to be run by the appliance but to delay the actual running of the program for some predetermined number of hours. Thus, for example, it is often desired to set up a dishwasher but delay the running of the program cycle for a number of hours so that the dishwasher is run in the middle of the night when no other appliances or showers are calling for hot water. Some attempts in the past to provide a program timer with a delayed start feature have utilized a second motor to time the delay period. Other attempts have utilized a complex arrangement driven by the timer motor to prevent the main program from becoming effective during the delay period. These prior attempts all have certain drawbacks such as requiring a separate motor or a complex mechanism.

It is therefore a primary object of the present invention to provide a delayed start arrangement for use in a program timer.

It is another object of the present invention to utilize only a single drive mechanism for both the delayed start arrangement and the main program.

It is a further object of the present invention to provide a delayed start arrangement for a program timer where the length of the delay is variable and may be set by an operator.

SUMMARY OF THE INVENTION

The foregoing and additional objects are attained in a program timer having a plurality of timing cams located on a rotating member and controlling the operation of switches in a predetermined program, the timer including a ratchet ring having spaced teeth mounted on the rotating member for movement therewith, a drive pawl, means for biasing the drive pawl against the ratchet ring, and drive means for reciprocating the drive pawl to advance the rotating member in a step-by-step manner, by providing a delay arrangement characterized by a ratchet wheel positioned adjacent the ratchet ring and aligned axially therewith, the root radii of the ratchet wheel teeth being no greater than the minimum root radius of the ratchet ring teeth, the drive pawl being of sufficient width to extend across at least a portion of both the ratchet ring and the ratchet wheel, some of the ratchet ring teeth being omitted in at least one position on the periphery of the ratchet ring so as to leave at least one gap where the drive pawl engages only the ratchet wheel teeth, means for coupling the rotating member to be moved by the ratchet wheel in one predetermined relative angular position of the ratchet wheel with respect to the rotating member, and manually operable means for moving the ratchet wheel independently of the rotating member to a selected angular position with respect to the rotating member so that when the drive pawl encounters the gap only the ratchet wheel is advanced until the predetermined relative angular position is attained.

BRIEF DESCRIPTION OF THE DRAWINGS

The foregoing will be more readily apparent upon reading the following description in conjunction with the drawings in which like elements in different figures thereof have the same reference character applied thereto and wherein.

DETAILED DESCRIPTION

Figure 2:
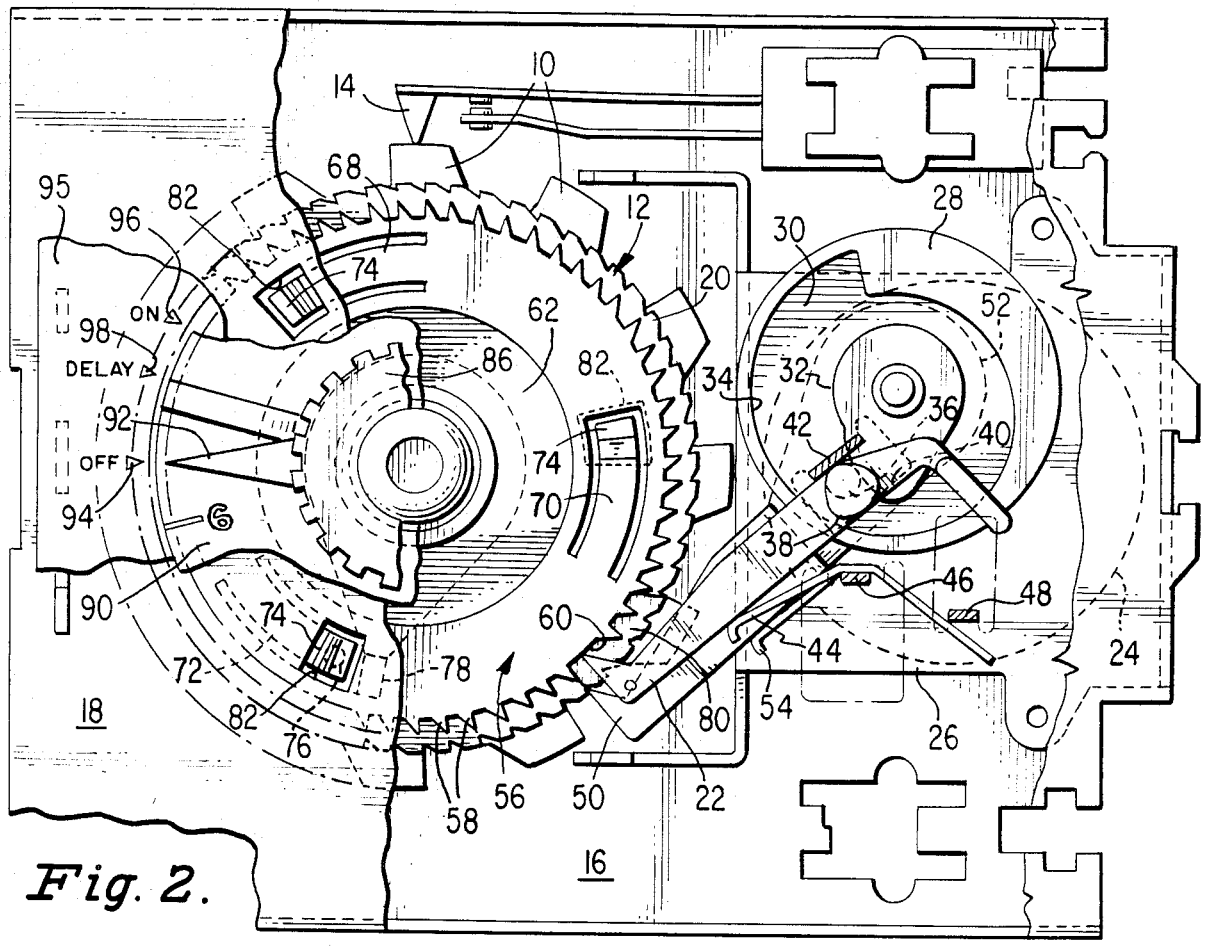
FIG. 2 is a plan view through the front plate of a progam timer having incorporated therein a delayed start arrangement according to this invention, with the timer being in the OFF state.
Figure 1:
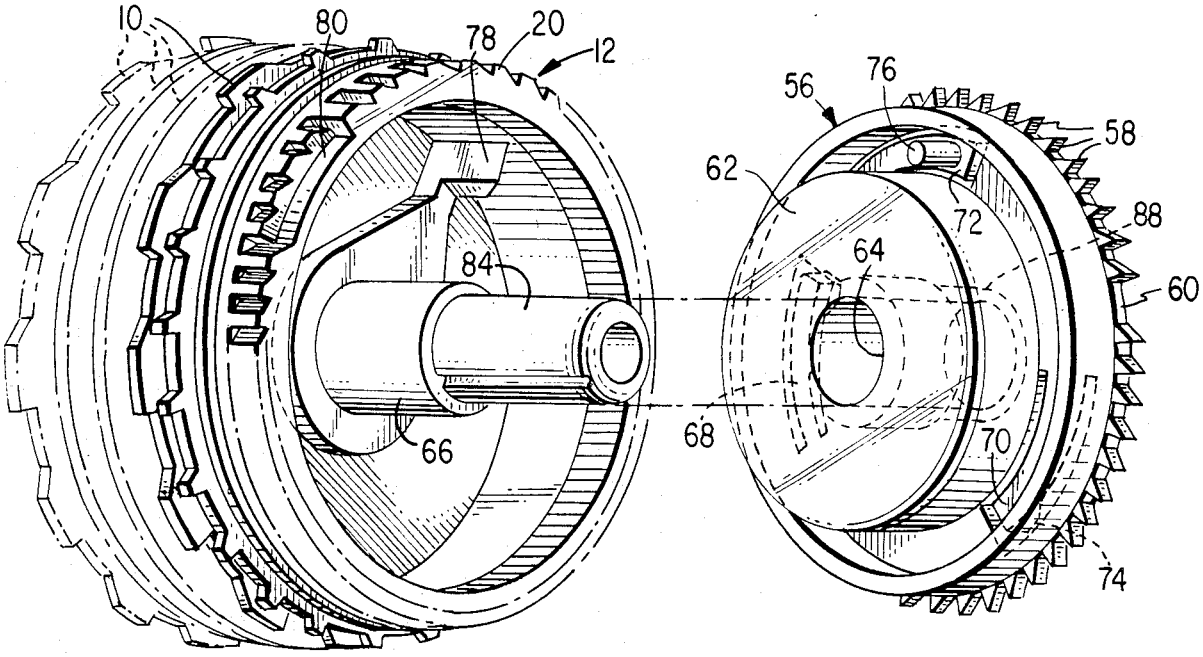
FIG. 1 is an exploded perspective view of the rotating member and the ratchet wheel according to this invention.
Figure 3:
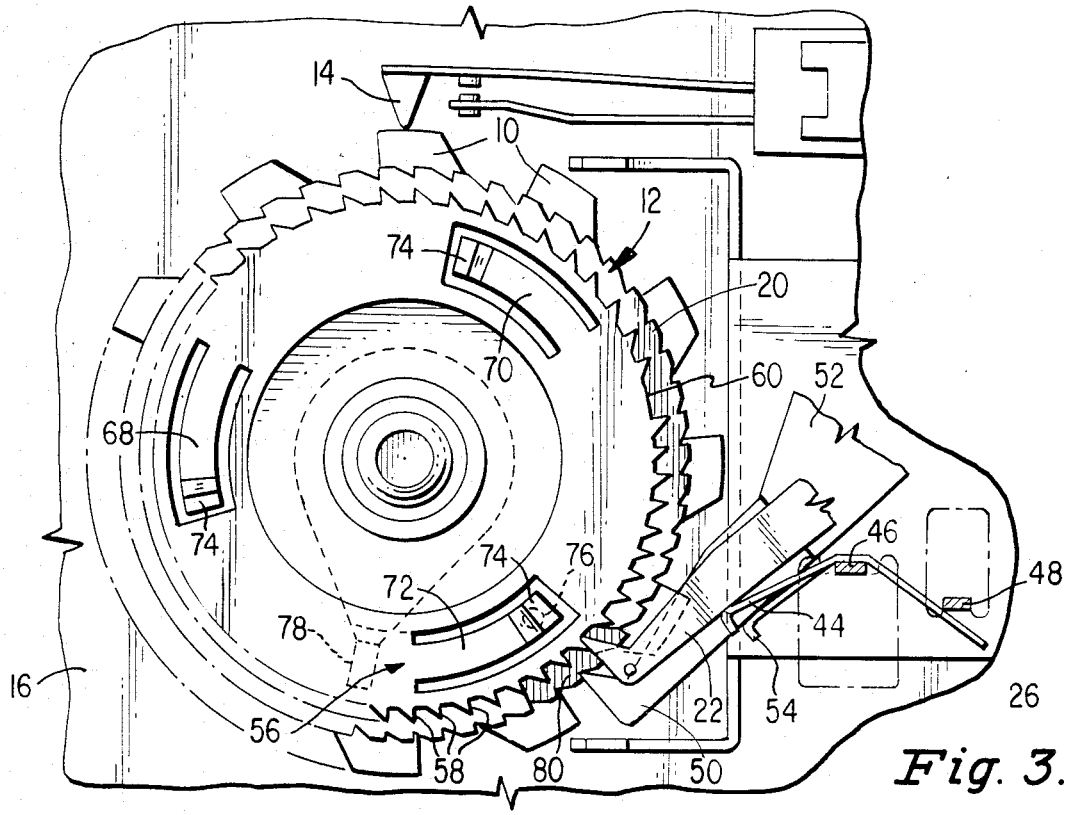
FIG. 3 is a plan view similar to FIG. 2 showing the program timer with the time delay in effect.

The drawings show relevant portions of a program timer necessary for an understanding of the present invention. Thus, as is well known, the illustrated program timer includes a plurality of timing cams 10 located on a rotating member 12 for controlling the operation of switches 14 in a predetermined program. In particular, the rotating member 12 is a hollow cam drum, sometimes referred to as a monoblock, which is rotatably journaled between a rear plate 16 and a front plate 18. The details of the monoblock 12 with respect to the timing cams 10 and the switches 14 are well known in the art and form no part of the present invention. The present invention is concerned with an arrangement wherein a variable delay may be provided under operator control for delaying running of the program.

For driving the monoblock 12 during the normal running of the program, there is provided a ratchet ring 20 mounted on the monoblock 12 for movement therewith. Preferably, the monoblock 12 is a unitary integrally molded piece and the ratchet ring 20 is a part thereof. The drive mechanism for advancing the monoblock 12 is illustratively of the type disclosed in U.S. Pat. No. 4,536,626, which issued to Guy Wojtanek on Aug. 20, 1985, and includes a drive pawl 22 operatively associated with the ratchet ring 20 to drive the monoblock 12 in a step-by-step manner. The drive power source is a motor 24 mounted on a motor frame 26 secured to the front plate 18. As is conventional, the motor 24 is a reduction motor having an output shaft. The output shaft of the motor 24 is coupled to rotate the drive cam 28 in a clockwise direction, as viewed in FIG. 2. The drive cam 28 comprises a disc having a channel 30 formed in one face thereof. The channel 30 forms a closed path surrounding the center of rotation of the drive cam 28 and has an inner wall 32 and an outer wall 34. The inner wall 32 forms a first camming surface for the drive stroke of the pawl 22 and the outer wall 34 forms a second camming surface for the return stroke of the drive pawl 22.

The drive pawl 22 is formed with a pin 36 which extends transversely to the direction of reciprocation of the drive pawl 22, which direction of reciprocation is along the major longitudinal axis of the pawl 22. The pin 36 acts as a cam follower and is adapted to extend into the channel 30 between the walls 32 and 34. The drive pawl 22 is further formed with a guide pin 38 on the opposite side of the pawl 22 from the cam follower pin 34. The guide pin 38 cooperates with an elongated slot 40 formed in the front plate 18 and a depending tab 42 formed from the front plate material cut away when the slot 40 was formed to keep the drive pawl 22 reciprocating in a linear direction substantially parallel to its major longitudinal axis. A leaf spring 44 held by by the depending tabs 46 and 48 is biased toward the ratchet ring 20 to yieldably bias the drive pawl 22 against the ratchet ring 20.

As is typical with a program timer, some means must be provided for preventing the monoblock 12 from rotating in a direction opposite from that in which it is driven by the drive pawl 22. Accordingly, an anti-reverse, or stop, pawl 50 is provided. The anti-reverse pawl 50 is formed with an enlarged extension 52 having an opening encircling a boss formed on the underside of the drive cam 28. The anti-reverse pawl 50 is yieldably biased against the ratchet ring 20 by means of a leaf spring 54 which, like the spring 44, is held by the tabs 46 and 48 and may even be formed as a separate finger of the same piece of material as the spring 44.

The present invention is concerned with providing a variable delay in a program timer. In the illustrative embodiment, the disclosed arrangement delays the start of the program for a selected period of time after power is applied to the motor 24. Accordingly, there is provided a ratchet wheel 56 which is adapted to be adjacent the ratchet ring 20 of the monoblock 12 and aligned axially therewith. The ratchet wheel 56 is formed with a single row of ratchet teeth 58. The ratchet teeth 58 preferably are of uniform height and spacing and extend around the entire circumference of the ratchet wheel 56 with the exception of a gap 60 where at least one tooth is omitted so as to form a dead zone where the drive pawl 22 cannot advance the ratchet wheel 56, as will be described hereinafter. The root radii of the ratchet teeth 58 are no greater than the minimum root radius of the teeth of the ratchet ring 20, for reasons which will become apparent. The ratchet wheel 56 is a unitary integrally molded piece and is formed with a circular boss 62 having a central opening 64 sized to fit over the axial hub 66 of the monoblock 12. This provides the alignment between the ratchet wheel 56 and the monoblock 12. The ratchet wheel 56 is also formed with a plurality of arcuate resilient tabs 68, 70 and 72 coplanar with the ratchet teeth 58. Each of the tabs 68, 70 and 72 is formed at its free end with a shoulder 74 extending out of the plane of the ratchet teeth 58 on the side opposite the boss 62. The free end of the tab 72 is formed with a projection, preferably the pin 76, extending in an axial direction out of the plane of the ratchet teeth 58 toward the monoblock 12. The monoblock 12 is further constructed to have an abutment 78 at a radial dimension such that it overlaps the radial dimension of the pin 76, when measured from the axis of the monoblock 12 and the ratchet wheel 56. The axial dimensions of the pin 76 and the abutment 78 are such that when the tab 72 is coplanar with the teeth 58 there is clearance between the pin 76 and the abutment 78. However, if the tab 72 is flexed toward the monoblock 12 such that the remote end of the shoulder 74 is substantially flush with the surface of the ratchet wheel 56, the pin 76 and abutment 78 will contact each other to couple the ratchet wheel 56 and the monoblock 12 for joint movement.

The ratchet ring 20 is formed with ratchet teeth for both the drive pawl 22 and the anti-reverse pawl 50. For the anti-reverse pawl 50, the ratchet teeth extend around the entire periphery of the ratchet ring 20, with no gaps. However, according to this invention, some of the ratchet ring teeth for the drive pawl 22 are omitted in at least one position on the periphery of the ratchet ring 20 so as to leave a gap 80. The drive pawl 22 is of sufficient width to extend across at least a portion of both the ratchet ring 20 and the ratchet teeth 58 of the ratchet wheel 56. Since the ratchet wheel teeth 58 are below the ratchet ring 20 teeth, the depth of the gap 80 is sufficient to allow the drive pawl 22 to engage the ratchet wheel teeth 58 when the drive pawl 22 is within the gap 80.

Figure 6:
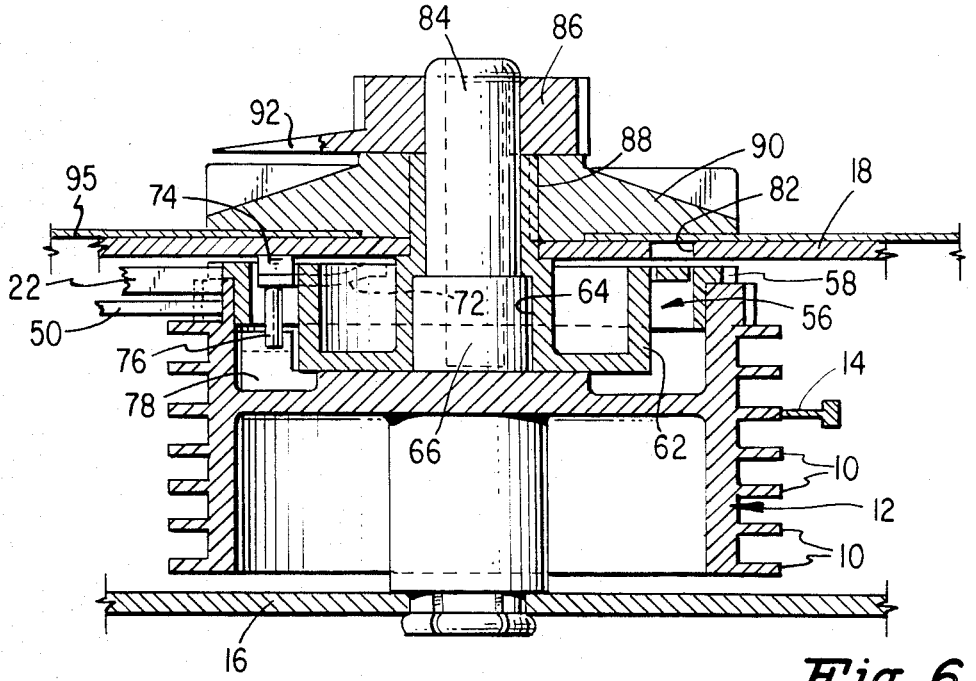
FIG. 6 is a detailed cross sectional view taken substantially along the line 6—6 in FIG. 4.

In accordance with this invention, the front plate 18 is formed with spaced openings 82. The openings 82 are evenly spaced to cooperate with the shoulders 74 on the resilient tabs 68, 70 and 72. Accordingly, when the ratchet wheel 56 is positioned so that the shoulders 74 are aligned with the openings 82, the resilient tabs 68, 70 and 72 are coplanar with the ratchet wheel 56. In other positions, the front plate 18 forces the resilient tabs 68, 70 and 72 toward the monoblock 12, as shown in FIG. 6.

The monoblock hub 66 is formed with an extension 84 adapted to receive thereon a control dial 86. The control dial 86 is keyed to the extension 84 in a conventional manner, such as by a flat on the extension 84 cooperating with a flat formed in the opening of the control dial 86. Similarly, the ratchet wheel 56 is formed with an axial extension 88 upon which is mounted a control dial 90 which is keyed to the extension 88.

FIGS. 2–5 illustrate the operation of the illustrative timer according to this invention. As shown in FIG. 2, the timer is in its OFF state where the drive pawl 22 is in the gap 80 of the ratchet ring 20 as well as the dead zone 60 of the ratchet wheel 56. Accordingly, even with the motor 24 being energized, the drive pawl 22 cannot advance either the ratchet wheel 56 or the monoblock 12. In this state, the ratchet wheel 56 is so oriented angularly that the shoulders 74 are within the openings 82 of the front plate 18. Accordingly, the pin 76 cannot engage the abutment 78. Thus, the control dial 86 can be moved to position the monoblock 12 independently of the ratchet wheel 56. From this OFF state, the operator can select whether the program timer is to be started immediately or with a selected delay. If an immediate start is desired, the operator moves the control dial 86 until its pointer 92 is moved from a position adjacent the OFF mark 94 on the appliance control panel 95 to a position adjacent the ON mark 96. This angular movement is sufficient to move the ratchet ring 20 so that the gap 80 is away from the drive pawl 22. When the motor 24 is subsequently energized to start the timer, the drive pawl 22 will be able to immediately engage the ratchet ring 20 and advance the monoblock 12. Since the dead zone 60 of the ratchet wheel 56 is in the active region of the drive pawl 22, the ratchet wheel 56 will not be advanced, even when the monoblock is rotated to where the drive pawl 22 enters the gap 80. Additionally, the position of the ratchet wheel 56 is such that the shoulders 74 are within the openings 82 so that as the monoblock advances and the abutment 78 passes the pin 76, there will be no engagement therebetween and the ratchet wheel 56 will maintain the position depicted in FIG. 2.

Assuming that the operator desires a delay interval before the start of the program, the control dial 86 is moved to where the pointer 92 is adjacent the DELAY mark 98 on the panel 95. This is the position of the monoblock 12 depicted in FIG. 3 wherein the drive pawl 22 still operates within the gap 80. At the same time, the control dial 90 is moved clockwise to a position corresponding to the desired delay interval. Since the delay interval is over when the gap 60 reaches the drive pawl 22, the more that the ratchet wheel 56 is moved, the closer the gap 60 is to the drive pawl 22. It therefore follows that an increase in the initial movement of the control dial 90 corresponds to a smaller delay interval. Thus, as viewed in FIG. 3, when a delayed start is in effect, the drive pawl 22 extends into the gap 80 of the ratchet ring 20 to engage the ratchet teeth 58 of the ratchet wheel 56. Accordingly, the ratchet wheel 56 is advanced. The friction of the shoulders 74 against the front plate 18 is sufficient to prevent reverse motion of the ratchet wheel 56. Therefore, an anti-reverse pawl is not required for the ratchet wheel 56.

Figure 4:
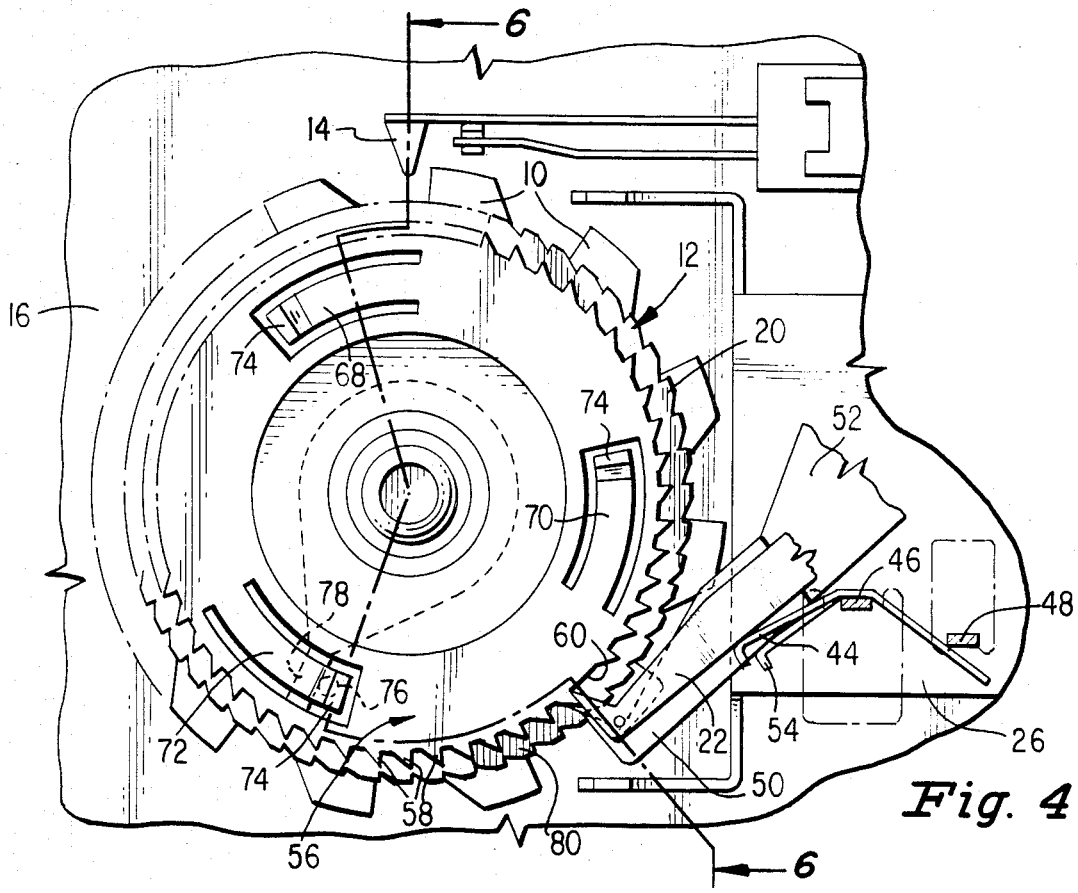
FIG. 4 is a plan view similar to FIG. 2 showing the program timer at the end of the time delay and the initiation of the main program.

The drive pawl 22 continues to advance only the ratchet wheel 56 until the ratchet wheel 56 is in such relative angular position with respect to the monoblock 12 that the pin 76 contacts the abutment 78. The placement of the openings 82 is such that there is engagement of the pin 76 and the abutment 78 at the end of the delay period before the shoulders 48 enter the openings 82. As shown in FIG. 4, when the pin 76 engages the abutment 78, the continued advancement of the ratchet wheel 56 will push the monoblock 12 until such time as the drive pawl 22 leaves the gap 80. This will occur at the same time that the drive pawl 22 enters the gap 60 of the ratchet wheel 56, as depicted in FIG. 4. Accordingly, the drive pawl 22 will thereafter advance only the monoblock 12. At this time, the shoulders 74 will have entered the openings 82 to free the pin 76 from the abutment 78.

Figure 5:
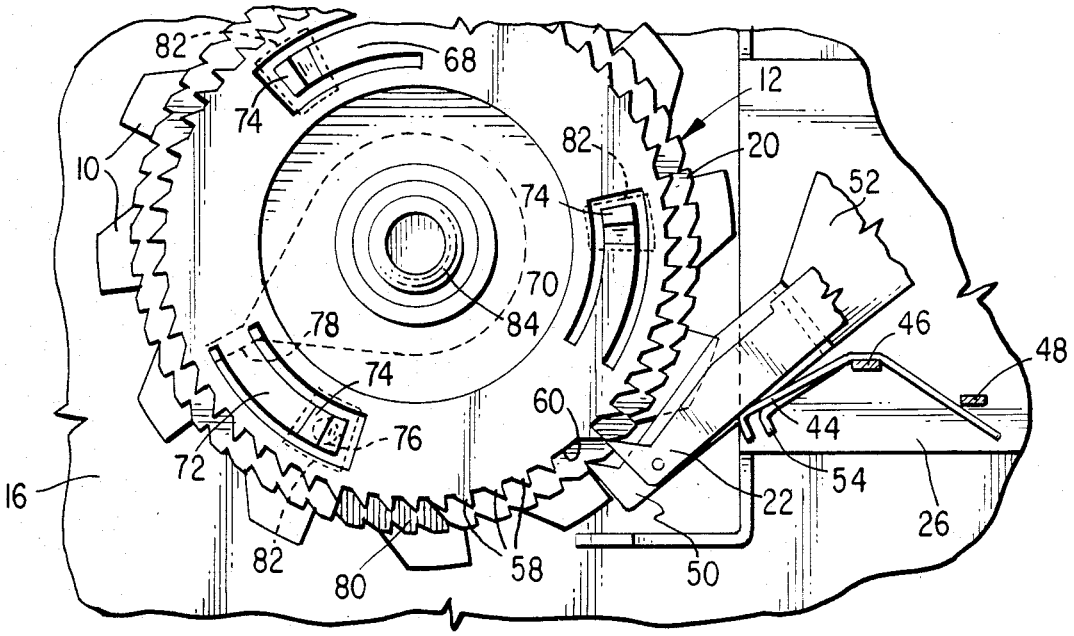
FIG. 5 is a plan view similar to FIG. 2 showing the main program in effect.

FIG. 5 shows the state of the timer when only the monoblock 12 is being advanced. This state will continue until such time as the gap 80 has traveled around to where the drive pawl 22 enters the gap 80. This is the OFF state of the timer depicted in FIG. 2.

Accordingly, there has been disclosed a variable delay arrangement for a program timer. It is understood that the above-described embodiment is merely illustrative of the application of the principles of this invention. Numerous other embodiments may be devised by those skilled in the art without departing from the spirit and scope of this invention, as defined by the appended claims. For example, it may be desirable to provide a delay interval at some point other than at the start of the program. Thus, in a dishwasher, a delay interval may be desired after an initial rinse. Accordingly, the gap 80 would in this case be provided on the ratchet ring 20 at the end of the initial rinse rather than at the start of the cycle.

I claim:

1. A program timer having a plurality of timing cams located on a rotating member and controlling the operation of switches in a predetermined program, said timer including a ratchet ring having spaced teeth mounted on said rotating member for movement therewith, a drive pawl, means for biasing said drive pawl against said ratchet ring, and drive means for reciprocating said drive pawl to advance the rotating memeber in a step-by-step manner, characterized by:

a ratchet wheel positioned adjacent said ratchet ring and aligned axially therewith, the root radii of the ratchet wheel teeth being no greater than the minimum root radius of the ratchet ring teeth, the drive pawl being of sufficient width to extend across at least a portion of both said ratchet ring and said ratchet wheel, some of said ratchet ring teeth being omitted in at least one position on the periphery of the ratchet ring so as to leave at least one gap where the drive pawl engages only the ratchet wheel teeth, means for coupling said rotating member to be moved by said ratchet wheel in one predetermined relative angular position of said ratchet wheel with respect to said rotating member, and manually operable means for moving said ratchet wheel independently of said rotating member to a selected angular position with respect to said rotating member so that when said drive pawl encounters said gap only said ratchet wheel is advanced until said predetermined relative angular position is attained.

2. The timer according to claim 1 further characterized in that at least one tooth is omitted from said ratchet wheel to form a dead zone where said drive pawl cannot advance said ratchet wheel, said dead zone being situated on the periphery of said ratchet wheel immediately behind said ratchet ring gap when said ratchet wheel and said rotating member are in said one predetermined relative angular position.

3. The timer according to claim 2 further characterized in that said coupling means includes a projection mounted on said ratchet wheel and extending axially toward said rotating member and an abutment mounted on said rotating member in a position such that it is engaged by said projection when said ratchet wheel and said rotating member are in said one predetermined relative angular position.

4. The timer according to claim 3 further characterized in that said timer includes a plate adjacent said ratchet wheel, said projection is mounted on a resilient tab having a shoulder across from said projection, said shoulder cooperating with said plate to flex said tab and said projection toward said rotating member, said plate having an opening positioned to received said shoulder so that said projection is disengaged from said abutment when said dead zone is positioned in the active region of said drive pawl.

5. The timer according to claim 1 further characterized in that said ratchet ring gap is positioned at the start of the program.

* * * * *